US006814089B1

(12) United States Patent
Voges

(10) Patent No.: US 6,814,089 B1
(45) Date of Patent: Nov. 9, 2004

(54) CONDITIONING LIQUID CLEANING AND RECYCLING SYSTEM FOR SHEET METAL CONDITIONING APPARATUS

(75) Inventor: Kevin C. Voges, Red Bud, IL (US)

(73) Assignee: The Material Works, Ltd., Red Bud, IL (US)

( * ) Notice: Subject to any disclaimer, the term of this patent is extended or adjusted under 35 U.S.C. 154(b) by 2 days.

(21) Appl. No.: 10/454,357

(22) Filed: Jun. 3, 2003

(51) Int. Cl.[7] ..... B08B 3/14

(52) U.S. Cl. ..... 134/111; 134/64 R; 134/122 R; 15/77

(58) Field of Search ..... 134/61, 64 R, 134/72, 109, 110, 111, 122 R; 15/77

(56) References Cited

U.S. PATENT DOCUMENTS

| | | | | |
|---|---|---|---|---|
| 2,318,432 A | | 5/1943 | Stanier | |
| 2,372,599 A | * | 3/1945 | Nachtman | 205/709 |
| 2,395,397 A | * | 2/1946 | Croft | 15/308 |
| 2,449,507 A | | 9/1948 | Pope | |
| 2,907,151 A | | 10/1959 | Peterson | |
| 3,686,921 A | | 8/1972 | Roper | |
| 3,722,251 A | | 3/1973 | Withrow | |
| 3,753,522 A | | 8/1973 | Voges | |
| 3,924,428 A | | 12/1975 | Noé | |
| 4,312,325 A | | 1/1982 | Voges | |
| 4,539,830 A | | 9/1985 | Noéet al. | |
| 4,751,838 A | | 6/1988 | Voges | |
| 4,872,245 A | | 10/1989 | Kawasaki et al. | |
| 4,887,502 A | | 12/1989 | Voges | |
| 4,920,603 A | * | 5/1990 | Keim et al. | 15/302 |
| 4,982,593 A | | 1/1991 | Holloway | |
| 5,055,870 A | * | 10/1991 | Ohba et al. | 396/611 |
| 5,077,887 A | | 1/1992 | Holloway | |
| 5,181,411 A | | 1/1993 | Holloway | |
| 5,248,372 A | * | 9/1993 | McNamee | 156/345.2 |
| 5,307,106 A | * | 4/1994 | Shigetaka et al. | 396/611 |
| 5,476,112 A | * | 12/1995 | Matsui et al. | 134/64 R |
| 5,579,658 A | | 12/1996 | Noéet al. | |
| 5,716,455 A | * | 2/1998 | Zednicek et al. | 134/2 |
| 5,759,307 A | | 6/1998 | Berger et al. | |
| 5,820,704 A | | 10/1998 | Veyer et al. | |
| 5,829,287 A | | 11/1998 | Noéet al. | |
| 6,021,790 A | * | 2/2000 | Yoshitani et al. | 134/62 |
| 6,088,895 A | | 7/2000 | Nelson et al. | |
| 6,089,063 A | | 7/2000 | Noe et al. | |
| 6,205,830 B1 | | 3/2001 | Voges | |
| 6,210,501 B1 | | 4/2001 | Okano et al. | |

FOREIGN PATENT DOCUMENTS

| | | |
|---|---|---|
| DE | 1452957 | 4/1969 |
| EP | 0498038 A2 | 2/1991 |
| JP | 58-116902 A | 7/1983 |
| SU | 158862 | 11/1963 |

OTHER PUBLICATIONS

3M Scotch–Brite Product Brochure, 1993, no month.
Leveltek International, LLC website information, Circa 1999, no month.

* cited by examiner

*Primary Examiner*—Frankie L Stinson
*Assistant Examiner*—Joseph L. Perrin
(74) *Attorney, Agent, or Firm*—Thompson Coburn, LLP

(57) ABSTRACT

A cleaning and recycling system for conditioning liquid used in a sheet metal conditioner recycles once cleaned conditioning liquid back through the sheet metal surface conditioner where the once cleaned conditioning liquid cools and lubricates brushes of the surface conditioner and also recycles twice cleaned conditioning liquid back through the surface conditioner where the twice cleaned conditioning liquid provides a final rinse to the sheet metal as it is discharged from the surface conditioner.

17 Claims, 2 Drawing Sheets

Figure 1:
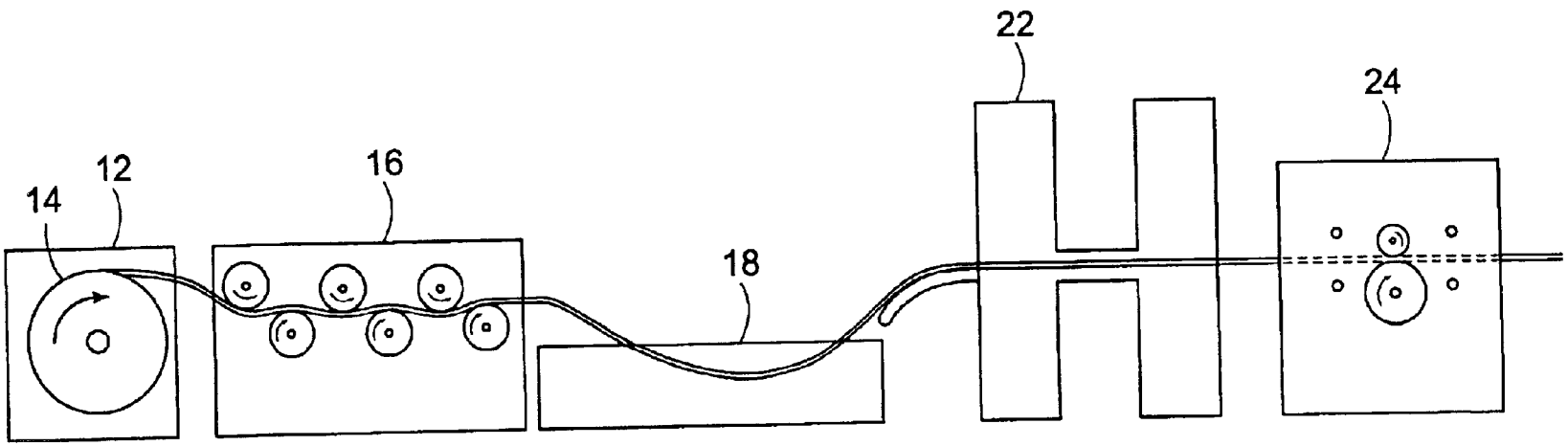

CONDITIONING LIQUID CLEANING AND RECYCLING SYSTEM FOR SHEET METAL CONDITIONING APPARATUS

BACKGROUND OF THE INVENTION (1) Field of the Invention

The present invention pertains to a cleaning system for a sheet metal conditioning apparatus. More specifically, the present invention pertains to a cleaning and recycling system for liquid used in a sheet metal surface conditioner that conditions sheets. of metal received from a stretching-leveling machine.

(2) Description of the Related Art

A wide variety of manufactured goods are constructed with processed sheet metal. For example, aircraft, automobiles, and home appliances, to name only a few, contain parts that are formed from processed sheet metal. These parts are formed by a stamping and/or blanking operation performed on the sheet metal.

Virtually all stamping and/or blanking operations performed on sheet metal require a flat sheet. However, sheet metal is typically purchased from steel mills and/or steel service centers as elongate sheets that have been rolled into large rolls for storage and shipping efficiency. Before the sheet metal can be used in the manufacturing of products, the sheet metal from the roll must be flattened. The surfaces of the sheet metal must also be conditioned to provide the product component part manufactured from the sheet metal with smooth surfaces.

One example of an apparatus that processes sheet metal is described in the U.S. Pat. of Voges No. 6,205,830 B1, which issued on Mar. 27, 2001, and is incorporated herein by reference. The apparatus described in this patent combines a stretching-leveling machine with a surface conditioning system. The stretching-leveling machine stretches sheet metal passed through the machine. The sheet metal is stretched beyond its yield point to provide a flat sheet of metal and to eliminate internal residual stresses from the sheet of metal. The stretching-leveling machine then discharges the stretched sheet of metal to the sheet metal surface conditioning system.

The surface conditioning system includes a surface conditioner that receives the sheet metal from the stretching-leveling machine and passes the sheet metal through a series of rotating brushes that engage the surfaces of the sheet metal. The rotating brushes remove scale and other smut from the surfaces of the sheet metal. A coolant/lubricant, for example water, is applied to the brushes during the cleaning operation to produce a cooler running operation, to wash away the scale and smut removed from the surfaces of the sheet metal, and to extend the useful life and effectiveness of the brushes.

Typically, the coolant/lubricant liquid is dispensed from a plurality of sprayer nozzles. The sprayer nozzles are spatially arranged along a spray bar that extends across the width of the sheet metal being passed through the sheet metal surface conditioner. Depending on the width of the sheet metal being processed, the sprayer bars positioned above and below the sheet metal passed through the surface conditioner have four or more sprayer nozzles spatially arranged along each bar. In addition, the typical sheet metal surface conditioner employs a plurality of sprayer bars positioned both above and below the sheet metal being passed through the surface conditioner. The coolant/lubricant is supplied to the sprayer nozzles of the surface conditioners at a rate of about 180 gallons per minute. This results in a substantial amount of coolant/lubricant conditioning liquid being dispensed in the sheet metal surface conditioner. This conditioning liquid is then removed from the sheet metal surface conditioner, with the scale and smut removed from the surfaces of the sheet metal being carried away by the conditioning liquid.

This prior art method of conditioning the surfaces of sheet metal is disadvantaged in that it requires a substantial amount of water. The cost of supplying a large amount of water to the surface conditioner adds to the cost of processing the sheet metal.

Disposing of the conditioning liquid contaminated by the scale and smut removed from the sheet metal also presents a sizeable problem. The contaminated conditioning liquid can be piped to a large retention pond where the scale and smut contaminating the conditioning liquid will settle down to the bottom of the pond over time. The somewhat cleaner conditioning liquid can then be piped off or hauled to a water treatment site or to a sewage site. However, this method of disposing of the contaminated conditioning liquid requires a large area adjacent to the metal processing facility for the retention pond.

Alternatively, the contaminated conditioning liquid can be shipped in large tanker trucks to a waste water treatment site. However, the use of large tanker trucks to dispose of the contaminated conditioning liquid adds to the cost of processing the sheet metal.

SUMMARY OF THE INVENTION

The present invention provides a cleaning and recycling system for the conditioning liquid used in sheet metal surface conditioners that overcomes the problems associated with sheet metal surface conditioners of the prior art. The cleaning and recycling system continuously reuses a large portion of the conditioning liquid that has been contaminated by the scale and smut removed from sheet metal without requiring a large settling pond by the sheet metal processing facility.

The cleaning and recycling system of the invention is employed with a sheet metal conditioner that has a first set of conditioning liquid dispensers that function primarily to assist the brushes of the conditioner to remove the scale and smut from the surfaces of the sheet metal, and a second set of conditioning liquid dispensers that function primarily to rinse the sheet metal before it is discharged from the sheet metal surface conditioner. Both the first and second sets of liquid dispensers dispense a coolant/lubricant liquid, typically water, onto the sheet metal as it passes through the rotating brushes of the sheet metal surface conditioner.

The conditioning liquid contaminated by the scale and smut removed from the sheet metal is removed from the sheet metal surface conditioner by the cleaning and recycling system of the invention. The conditioning liquid contaminated with the scale and smut is directed through a first filter where a substantial portion of the scale and smut is removed from the conditioning liquid. The conditioning liquid that passes through the first filter is then collected in a recycling tank.

A substantial portion of the liquid contained in the recycling tank is then pumped back to the sheet metal surface conditioner. The conditioning liquid that has passed through the first filter is pumped to the first set of liquid dispensers of the sheet metal surface conditioner where the primary function of the liquid is to cool and lubricate the brushes of the surface conditioner and to carry away the scale and smut removed from the surfaces of the sheet metal by the brushes. The cleanliness of the conditioning liquid is not of primary importance for performing this function.

The cleaning and recycling system of the invention also includes a second filter that communicates with the conditioning liquid in the recycling tank through a metered valve. A portion of the conditioning liquid collected in the recycling tank is pumped through the metered valve and through the second filter which further filters smaller particles of the scale and smut from the conditioning liquid that were not removed by the first filter. The liquid that passes through the second filter is then directed back to the sheet metal surface conditioner where the liquid is dispensed from the second set of liquid dispensers. This second set of liquid dispensers rinses the surfaces of the sheet metal just before it is discharged from the sheet metal surface conditioner. For the rinsing function performed by the second set of liquid dispensers, the cleanliness of the conditioning liquid is of greater importance. The liquid dispensed by the second set of liquid dispensers in the surface conditioner, having been passed through both the first and second filters of the filtering and recycling system, is cleaner than the liquid dispensed by the first set of liquid dispensers which has only been passed through the first filter.

Thus, the cleaning and recycling system of the invention continuously reuses the conditioning liquid that has been contaminated with scale and smut removed from sheet metal passed through the sheet metal surface conditioner and overcomes the problems associated with prior art sheet metal surface conditioners.

BRIEF DESCRIPTIONS OF THE DRAWING FIGURES

Figure 2:
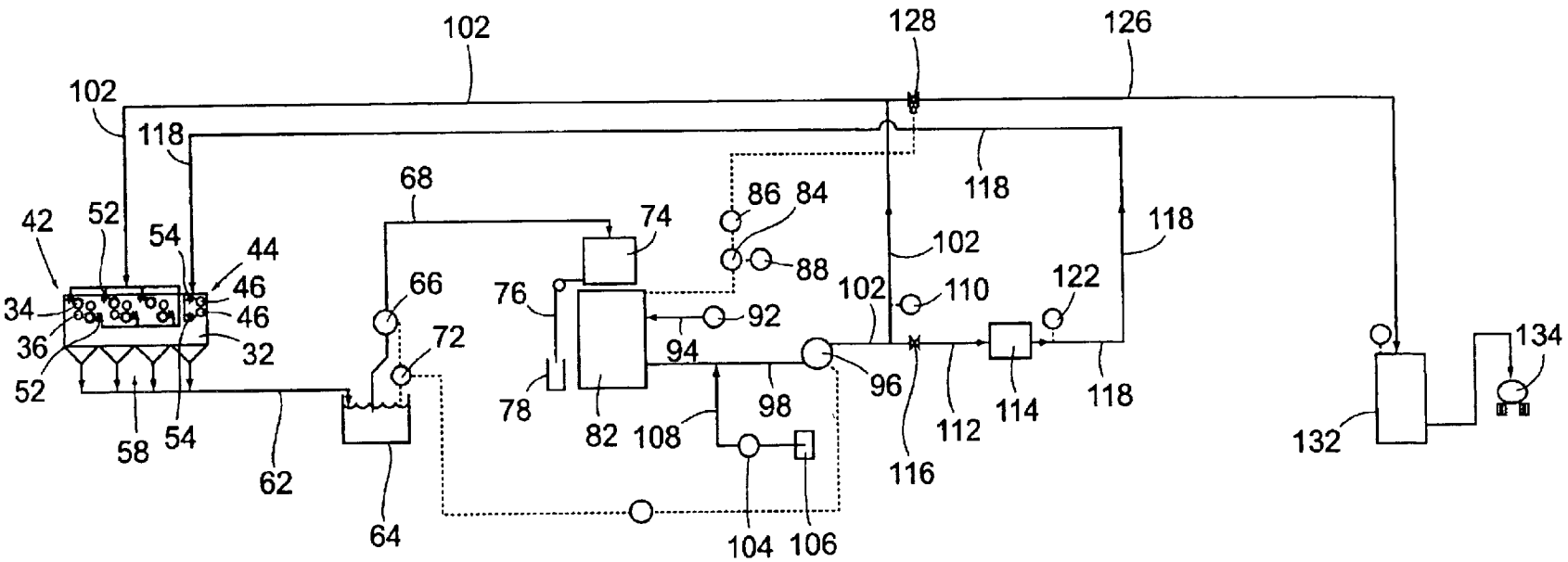

Further features of the invention are set forth in the following detailed description of the preferred embodiment of the invention and in the drawing figures wherein:

FIG. 1 shows a schematic representation of a sheet metal stretching-leveling machine used in combination with a sheet metal surface conditioner that employs the cleaning and recycling system of the invention; and FIG. 2 shows a schematic representation of the cleaning and recycling system for the conditioning liquid used in the sheet metal surface conditioner of FIG. 1.

DETAILED DESCRIPTION OF THE PREFERRED EMBODIMENT

The present invention provides a cleaning and recycling system for the conditioning liquid used in a sheet metal surface conditioner that is similar to the sheet metal surface conditioner disclosed and described in U.S. Pat. No. 6,205,830 B1. FIG. 1 shows a schematic representation of an in-line metal processing apparatus that includes a sheet metal surface conditioner of the type described in the above-referenced patent. In general, the in-line metal processing apparatus shown in FIG. 1 comprises a reel mechanism 12 that dispenses a roll 14 of sheet metal, a sheet metal roll straightener 16, a take up pit 18, a sheet metal stretching and leveling mechanism 22, and a surface conditioner 24. Each of these component parts of the in-line metal processing apparatus shown in FIG. 1 is described in the earlier referenced U.S. patent, and therefore will not be described here. The subject matter of the present invention concerns improvements made to a sheet metal surface conditioner of the type employed in the in-line metal processing apparatus of FIG. 1.

FIG. 2 shows a schematic representation of the present invention which provides a cleaning and recycling system for the conditioning liquid used in a sheet metal surface conditioner. Basically, the cleaning and recycling system continuously reuses a large portion of the conditioning liquid that has been contaminated by the scale and smut removed from sheet metal passed through the sheet metal surface conditioner.

The sheet metal surface conditioner 32 of the system is similar to prior art sheet metal surface conditioners in that it is provided with a plurality of opposed pairs of rotating brushes 34 and back up rollers 36. As shown in FIG. 2, sheet metal passed through the surface conditioner 32 moves from an input end 42 of the conditioner shown to the left in FIG. 2, to an output end 44 of the conditioner shown to the right in FIG. 2. Sheet metal that has been straightened, stretched and leveled by the metal processing apparatus such as that shown in FIG. 1 is received at the input end 42 of the sheet metal surface conditioner 32. The sheet metal passes through the surface conditioner 32 and is discharged by a pair of output rollers 46 at the output end 44 of the surface conditioner.

The surface conditioner of the invention includes a first set of conditioning liquid dispensers or sprayer nozzles 52 and a second set of conditioning liquid dispensers or sprayer nozzles 54. Both the first 52 and second 54 sets of liquid dispensers dispense a coolant/lubricant liquid, typically water, onto the sheet metal as it passes through the rotating brushes 34 of the sheet metal surface conditioner 32. As in the prior art, the rotating brushes 34 remove scale and other smut from the surfaces of the sheet metal as it is passed through the surface conditioner 32.

The first set of conditioning liquid dispensers 52 are associated with the brushes 34 adjacent the input end 42 of the surface conditioner. These liquid dispensers 52 or sprayer nozzles are spatially arranged along sprayer bars that extend along the lengths of the brushes 34. As in the prior art, the sprayer bars are positioned both above and below the sheet metal being passed through the surface conditioner. The first set of conditioning liquid dispensers 52 dispense the conditioning liquid toward the rotating brushes 32 as sheet metal is passed through the conditioner and function primarily to cool and lubricate the brushes and to assist the brushes in removing scale and smut from the surfaces of the sheet metal passed through the conditioner.

The second set of conditioning liquid dispensers 54 is positioned adjacent the output rollers 46 and the output end 44 of the liquid conditioner. Unlike the prior art conditioning liquid dispensers, the second set of conditioning liquid dispensers 54 is separate from the first set of dispensers 52, and function primarily to rinse the sheet metal that has been conditioned by the brushes 34 before the sheet metal is discharged from the sheet metal surface conditioner 32. The second set of conditioning liquid dispensers 54 are also spatially arranged along sprayer bars that extend along the lengths of the output rollers 46 and are positioned above and below the sheet metal passed through the surface conditioner.

A drainage system 58 is positioned beneath the surface conditioner 32 to recover the conditioning liquid that has been contaminated with the scale and smut removed from the sheet metal. The drainage system 58 directs the recovered contaminated conditioning liquid to a flume 62. The flume 62 channels the contaminated conditioning liquid to a sump 64. The sump 64 collects the contaminated conditioning liquid for latter cleaning and reuse in the surface conditioner 32.

A sump pump or slurry pump 66 communicates with the contaminated conditioning liquid in the sump 64 through a sump conduit 68. A level switch 72 communicates electronically with the sump pump 66 and controls the operation of the sump pump 66, as well as a recycling pump of the system that will be described latter. The level switch 72 is comprised of three probes positioned in the sump 64. The three probes measure a low level of the contents of the sump, a high level of the sump contents, and a high-high level of the sump contents. The level switch 72 operates the sump pump 66 and the recycling pump of the system to be latter described depending on the sensed level of contaminated conditioning liquid in the sump 66 by the three probes of the level switch.

The sump conduit 68 extends from the sump pump 66 to a first cleaner that performs a first cleaning operation on the conditioning liquid. There are various different known devices that are capable of removing or cleaning particulate contaminates from a liquid that could be used as the first cleaner. In the system of the invention shown in FIG. 1, the first cleaner is a first filter 74 of the system. This first filter 74 is a cartridge filter or media filter that is capable of attaining a 99% reduction by weight of the scale and smut or other particles contaminating the conditioning liquid passed through the filter. The contaminates removed from the conditioning liquid passed through the first filter 74 are periodically removed from the filter and are directed through a waste channel 76 to a waste bin 78 where the contaminates are collected for latter disposal. The conditioning liquid filtered by the first filter 78 is then collected in a recirculation tank 82 where it is collected for reuse in the surface conditioner 32.

A probe of a level indicator 84 is mounted in the interior of the recirculation tank 82 for monitoring the level of conditioning liquid in the tank. The level indicator 84 also communicates electronically with a level alarm (high) 86 and a level alarm (low) 88 that in turn communicate electronically with a solenoid operated valve to be described latter to maintain the level of the conditioning liquid in the recirculation tank 82 in a desired range.

A fresh water pump 92 communicates with the interior of the recirculation tank 82 through a fresh water conduit 94. The fresh water pump 92 can be operated continuously to supply a constant stream of fresh water to the conditioning liquid collected in the recirculation tank 82. Alternatively, the fresh water pump 92 can be operated on an as needed basis to maintain the level of the conditioning liquid in the recirculation tank 82 at a desired level.

A recycling pump 96 communicates with the recirculation tank 82 through a first liquid return path conduit 98. The recycling pump 96 also communicates with the first set of conditioning liquid dispensers 52 through additional lengths of conduit 102 that make up the remainder of the first liquid return path. The recycling pump 96 communicates electronically with the level switch 72 that monitors the level of contaminated conditioning liquid in the sump 64. The operation of the recycling pump 96 is dependent on signals the pump receives from the level switch 72, as will be explained.

An algicide pump 104 communicates through an algicide conduit 108 with an algicide tank 106 and with the conduit 98 of the first liquid return path communicating the recycling pump 96 with the recirculation tank 82. The algicide pump 104 is a metering pump that supplies a continuous, metered supply of algicide to the conditioning liquid that passes through the conduit 98 of the first liquid return path.

A flow meter 110 is positioned along the additional conduits 102 of the first liquid return path. The flow meter 110 monitors the rate of liquid flow through the first liquid return path by sensing pressure changes in the liquid flow.

A conduit 112 of a second liquid return path branches off from the conduit 102 of the first liquid return path and communicates the first liquid return path with a second cleaner that performs a second cleaning operation on the once cleaned conditioning liquid. Various different known devices capable of removing or cleaning particulate contaminates from a liquid could be used as the second cleaner. In the system of the invention, the second cleaner is a second filter 114. The second filter 114 is a refining cartridge filter that is capable of removing fine particles from the conditioning liquid down to one micron in size. Communication between the conduit 102 of the first liquid return path and the second filter 114 is controlled by a metering valve 116 positioned along the conduit 112 of the second liquid return path. Thus, the second filter 114 further filters conditioning liquid that has been previously filtered by the first filter 74. Additional conduits 118 of the second liquid return path communicate the second filter 114 with the second set of conditioning liquid dispensers 54 in the sheet metal surface conditioner 32. A flow meter 122 communicates with the additional conduits 118 of the second liquid return path and monitors the rate of flow of liquid through the second filter 114. This flow meter 122 indicates if the second filter 114 becomes full or clogged with particles filtered from the conditioning liquid. Restricted flow of conditioning liquid through the second filter 114 will result in a pressure drop in the additional conduits 118 of the second liquid return path which is sensed by the flow meter 122. To first achieve the desired flow of conditioning liquid through the second filter 114 and the additional conduits 118 of the second liquid return path, the metering valve 116 can be adjusted.

A draw off conduit 126 also branches off from the additional conduits 102 of the first liquid return path. A flow of conditioning liquid from the additional conduits 102 of the first liquid return path through the draw off conduit 126 is controlled by intermittent operation of a solenoid-metering valve 128. This valve 128 communicates electronically with the level indicator 84 of the recirculation tank 82 and is operated dependent on signals received from the level indicator 84. The conditioning liquid drawn off from the first liquid return path conduits 102 through the draw off conduit 126 is collected in a storage tank 132. The collected conditioning liquid in the storage tank 132 can be periodically hauled away by a tank truck 134.

In operation of the cleaning and recycling system of the invention, the sump pump 66, level switch 72, level indicator 84, fresh water pump 92, recycling pump 96, algicide pump 104, flow meter 110, metering valve 116, flow meter 122, and metering valve 128 all intercommunicate through a computerized control system (not shown) that controls the operation of the cleaning and recycling system. Contaminated conditioning liquid that contains the scale, smut and other particles removed from the sheet metal passed through the sheet metal surface conditioner 32 passes through the drain system 58 of the conditioner to the flume 62. This includes the conditioning liquid that has been once filtered and dispensed through the first set of conditioning liquid dispensers 52, and the conditioning liquid that has been twice filtered and dispensed through the second set of conditioning liquid dispensers 54. The contaminated conditioning liquid is directed by the flume 62 to the sump 64 where it is collected.

The level switch 72 of the sump detects the level of contaminated conditioning liquid in the sump. If the level is low, the sump pump 66 is switched off, thereby allowing contaminated conditioning liquid to collect in the sump. When the level of contaminated conditioning liquid collected in the sump 64 reaches a high level sensed by the level switch 72, the sump pump 66 is switched on causing the sump pump 66 to pump the conditioning liquid to the first filter 74. If a high-high level of the conditioning liquid in the sump 64 is detected by the level switch 72, an alarm is sounded, an alarm light is lit on a control panel (not shown) of the system control, and the recycling pump 96 is switched off, thereby stopping the supply of filtered conditioning liquid to the sheet metal surface conditioner 32 and limiting any further accumulation of contaminated conditioning liquid in the sump 64. On further operation of the sump pump 66, the level of contaminated conditioning liquid collected in the sump 64 is lowered to a point that the level switch 72 of the sump determines that the recycling pump 96 can again be switched on. The sump pump 66 pumps the liquid through the sump conduit 68 to the first filter 74.

The contaminated conditioning liquid passes through the first filter 74 and the filtered conditioning liquid is collected in the recirculation tank 82.

The level of conditioning liquid in the recirculation tank 82 is monitored by the level indicator 84. The once filtered conditioning liquid in the recirculation tank 82 is pumped by the recycling pump 96 through the conduits 98, 102 defining the first liquid return path back to the sheet metal surface conditioner 32. If desired, an algicide can be added to the once filtered conditioning liquid by operation of the algicide pump 104. In the surface conditioner 32 the once filtered conditioning liquid is dispensed through the first set of conditioning liquid dispensers 52. This conditioning liquid is used to cool and lubricate the brushes 34 of the surface conditioner and to carry off scale and smut removed from the sheet metal, but is not clean enough to rinse the sheet metal passed through the surface conditioner.

Because the once filtered conditioning liquid in the recirculation tank 82 is not clean enough to rinse the sheet metal passed through the sheet metal surface conditioner 32, the once filtered conditioning liquid is filtered a second time by being pumped through the second filter 114 by the recycling pump 96. The amount of once filtered conditioning liquid passed through the second filter 114 is controlled by the metering valve 116 in the second liquid return path. The second filter 114 removes most of the remaining particles in the once filtered conditioning liquid down to one micron in size. The recycling pump 96 pumps a portion of the once filtered conditioning liquid through the second filter 114 and the conduits of the second liquid return path 112, 118 back to the surface conditioner 32. In the surface conditioner 32 the twice filtered conditioning liquid is dispensed from the second set of conditioning liquid dispensers 54 and provides a final rinse of the sheet metal at the output end 44 of the conditioner. The flow of the twice-filtered conditioning liquid is monitored by the flow meter 122 in the second liquid return path downstream of the second filter 114. Depending on the flow rate detected by the flow meter 122, the metering valve 116 just upstream of the second filter 114 is adjusted to maintain a desired flow of twice filtered conditioning liquid through the second liquid return path to the second set of conditioning liquid dispensers 54 of the surface conditioner 32.

The level of once filtered conditioning liquid in the recirculation tank 82 is monitored and maintained by the level indicator 84. The level indicator 84 communicates with the metering valve 128 in the draw off conduit 126 and controls the intermittent opening and closing of the valve. When the level indicator 84 senses a high level of conditioning liquid in the recirculation tank 82, an alarm is sounded and the metering valve 128 in the draw off conduit 126 is opened. This allows conditioning liquid to be bled off of the first liquid return path through the draw off conduit 126 to the storage tank 132. From the storage tank 132 the bled off conditioning liquid can be periodically hauled away by a tank truck 134. When the level of once filtered conditioning liquid in the recirculation tank 82 reaches a low level sensed by the level indicator 84, the indicator controls the metering valve 128 to close allowing the level of once filtered conditioning liquid in the recirculation tank 82 to again rise.

The cleaning and recycling system of the invention described above continuously reuses the conditioning liquid that has been contaminated with the scale and smut removed from sheet metal passed through the sheet metal surface conditioner. The two step filtering process allows once filtered conditioning liquid to be reused for the purpose of washing away the scale and smut removed from the processed sheet metal and allows the twice filtered conditioning liquid to be reused to provide a final rinse to the sheet metal passed through the surface conditioner. By continuously reusing the conditioning liquid in the two-filter system, the problems associated with the prior art are overcome.

While the present invention has been described above in reference to a specific embodiment, it should be understood that other modifications and variations could be constructed without departing from the scope of the invention as set forth in the following claims.

What is claimed is:

1. A cleaning and recycling system for liquid used in a sheet metal conditioner, the system comprising:

a sheet metal conditioner having a surface conditioning device that conditions surfaces of sheet metal passed through the sheet metal conditioner, a first conditioning liquid dispenser that dispenses conditioning liquid in the sheet metal conditioner, and a second conditioning liquid dispenser that dispenses conditioning liquid in the sheet metal conditioner;

a first cleaner in liquid communication with the sheet metal conditioner to receive and clean conditioning liquid from the sheet metal conditioner;

a first liquid return path communicating the first cleaner with the first conditioning liquid dispenser to conduct conditioning liquid once cleaned by the first cleaner to the first conditioning liquid dispenser;

a second cleaner in liquid communication with the sheet metal conditioner to receive and clean conditioning liquid from the sheet metal conditioner;

a second liquid return path communicating the second cleaner with the second conditioning liquid dispenser to conduct conditioning liquid cleaned by the second cleaner to the second conditioning liquid dispenser, the conditioning liquid cleaned by the second cleaner being cleaner than the conditioning liquid cleaned by the first cleaner; and the second cleaner being in liquid communication with the first cleaner and arranged to receive cleaned conditioning liquid from the first cleaner and clean the conditioning liquid once cleaned by the first cleaner.

2. The system of claim 1, further comprising:

the second liquid return path being separate from the first liquid return path.

3. The system of claim 1, further comprising:

a source of water communicating with the first liquid return path to dilute the conditioning liquid cleaned by the first cleaner.

4. The system of claim 3, further comprising:

the second cleaner being in liquid communication with the first cleaner and the source of water to receive and clean the conditioning liquid once cleaned by the first cleaner and diluted with water.

5. The system of claim 1, further comprising:

a source of algicide communicating with the first liquid return path to add algicide to the conditioning liquid cleaned by the first cleaner.

6. The system of claim 1, further comprising:

a sump in liquid communication with the sheet metal conditioner to receive conditioning liquid from the sheet metal conditioner; and, the first cleaner being in liquid communication with the sheet metal conditioner through the sump.

7. The system of claim 6, further comprising:

a pump in liquid communication with the sump and the first cleaner to pump conditioning liquid from the sump and through the first cleaner.

8. The system of claim 1, further comprising:

a sheet metal stretcher that stretches sheet metal and provides stretched sheet metal to the sheet metal conditioner.

9. A cleaning and recycling system for liquid used in a sheet metal conditioner, the system comprising:

a sheet metal conditioner having a surface conditioning device that conditions surfaces of sheet metal passed through the sheet metal conditioner, a first conditioning liquid dispenser that dispenses conditioning liquid in the sheet metal conditioner, and a second conditioning liquid dispenser that dispenses conditioning liquid in the sheet metal conditioner;

a first cleaner in liquid communication with the sheet metal conditioner to receive and clean conditioning liquid from the sheet metal conditioner;

a first liquid return path communication the first cleaner with the first conditioning liquid dispenser to conduct conditioning liquid once cleaned by the first cleaner to the first conditioning liquid dispenser;

a second cleaner in liquid communication with the sheet metal conditioner to receive and clean conditioning liquid from the sheet metal conditioner;

a second liquid return path communication the second cleaner with the second conditioning liquid dispenser to conduct conditioning liquid cleaned by the second cleaner to the second conditioning liquid dispenser, the conditioning liquid cleaned by the second cleaner being cleaner than the conditioning liquid cleaned by the first cleaner; and a pump in liquid communication with the first liquid return path and the second liquid return path to pump conditioning liquid cleaned by the first cleaner through the first liquid return path and to pump conditioning liquid cleaned by the first cleaner through the second cleaner and the second liquid return path.

10. A cleaning and recycling system for liquid used in a sheet metal surface conditioner, the system comprising:

a sheet metal surface conditioner having an input end and an output end, a surface conditioning device that conditions surfaces of sheet metal passed through the sheet metal surface conditioner from the input end to the output end, a first conditioning liquid dispenser adjacent the input end of the sheet metal surface conditioner and a second conditioning liquid dispenser adjacent the output end of the sheet metal surface conditioner;

a first cleaner in liquid communication with the sheet metal surface conditioner to receive and clean conditioning liquid from the sheet metal surface conditioner;

a first liquid return path communicating the first cleaner with the first conditioning liquid dispenser to conduct conditioning liquid cleaned by the first cleaner to the first conditioning liquid dispenser;

a second cleaner in liquid communication with the sheet metal surface conditioner to receive and clean conditioning liquid from the sheet metal surface conditioner;

a second liquid return path communicating the second cleaner with the second conditioning liquid dispenser to conduct conditioning liquid cleaned by the second cleaner to the second conditioning liquid dispenser, the conditioning liquid dispensed by the second conditioning liquid dispenser being cleaner than the conditioning liquid dispensed by the first conditioning liquid dispenser;

the first conditioning liquid dispenser being separate from the second conditioning liquid dispenser and the first liquid return path being separate from the second liquid return path; and the second cleaner being in liquid communication with the first cleaner and arranged to receive cleaned conditioning liquid from the first cleaner and clean the conditioning liquid once cleaned by the first cleaner.

11. The system of claim 10, further comprising:

a first pump in liquid communication with the sheet metal surface conditioner to receive conditioning liquid from the sheet metal surface conditioner and pump the conditioning liquid through the first cleaner and the first liquid return path.

12. The system of claim 11, further comprising:

a second pump in liquid communication with the first cleaner to receive the conditioning liquid cleaned by the first cleaner and pump the conditioning liquid once cleaned by the first cleaner through the second cleaner and the second liquid return path.

13. The system of claim 10, further comprising:

a source of water communicating with the first liquid return path to dilute the conditioning liquid cleaned by the first cleaner.

14. The system of claim 10, further comprising:

a storage tank in the first liquid return path to store the conditioning liquid cleaned by the first cleaner.

15. The system of claim 10, further comprising:

a sump in liquid communication with the sheet metal surface conditioner to receive conditioning liquid from the sheet metal surface conditioner; and, the first cleaner being in liquid communication with the sheet metal surface conditioner through the sump.

16. The system of claim 10, further comprising:

a sheet metal stretcher that stretches sheet metal and provides stretched sheet metal to the sheet metal surface conditioner.

17. A cleaning and recycling system for liquid used in a sheet metal surface condition, the system comprising:

a sheet metal surface conditioner having an input end and an output end, a surface conditioning device that conditions surfaces of sheet metal passed through the sheet metal surface conditioner from the input end to the output end, a first conditioning liquid dispenser adjacent the input end of the sheet metal surface conditioner and a second conditioning liquid dispenser adjacent the output end of the sheet metal surface conditioner;

a first cleaner in liquid communication with the sheet metal surface conditioner to receive and clean conditioning liquid from the sheet metal surface conditioner;

a first liquid return path communicating the first cleaner with the first conditioning liquid dispenser to conduct conditioning liquid cleaned by the first cleaner to the first conditioning liquid dispenser;

a second cleaner in liquid communication with the sheet metal surface conditioner to receive and clean conditioning liquid from the sheet metal surface conditioner;

a second liquid return path communicating the second cleaner with the second conditioning liquid dispenser to conduct conditioning liquid cleaned by the second cleaner to the second conditioning liquid dispenser, the conditioning liquid dispensed by the second conditioning liquid dispenser being cleaner than the conditioning liquid dispensed by the first conditioning liquid dispenser;

the first conditioning liquid dispenser being separate from the second conditioning liquid dispenser and the first liquid return path being separate from the second liquid return path; and a pump in liquid communication with the first liquid return path to pump conditioning liquid cleaned by the first cleaner through the first liquid return path and to pump conditioning liquid once cleaned by the first cleaner through the second cleaner and the second liquid return path.

* * * * *